US006963258B2

(12) United States Patent
Atokawa et al.

(10) Patent No.: US 6,963,258 B2
(45) Date of Patent: Nov. 8, 2005

(54) VARIABLE-FREQUENCY RESONATOR CIRCUIT, VARIABLE-FREQUENCY FILTER, SHARED-ANTENNA DEVICE, AND COMMUNICATION DEVICE

(75) Inventors: Masayuki Atokawa, Kanazawa (JP); Nobuyoshi Honda, Kanazawa (JP); Kyoji Matsunaga, Kanazawa (JP)

(73) Assignee: Murata Manufacturing Co., Ltd. (JP)

( * ) Notice: Subject to any disclaimer, the term of this patent is extended or adjusted under 35 U.S.C. 154(b) by 61 days.

(21) Appl. No.: 10/160,198

(22) Filed: May 30, 2002

(65) Prior Publication Data

US 2002/0180568 A1 Dec. 5, 2002

(30) Foreign Application Priority Data

May 30, 2001 (JP) ..... 2001-163149

(51) Int. Cl.[7] ..... H01P 1/20
(52) U.S. Cl. ..... 333/202; 333/103; 333/134
(58) Field of Search ..... 333/101, 103, 333/104, 132, 134, 174, 175, 202, 205, 207, 235

(56) References Cited

U.S. PATENT DOCUMENTS 4,590,417 A * 5/1986 Tanaami et al. ..... 333/81 R
5,327,017 A * 7/1994 Fischer et al. ..... 333/103
5,519,364 A * 5/1996 Kato et al. ..... 333/103
5,594,394 A * 1/1997 Sasaki et al. ..... 333/103
5,748,054 A * 5/1998 Tonegawa et al. ..... 333/104
6,448,868 B2 * 9/2002 Kato et al. ..... 333/103
6,590,475 B2 * 7/2003 Yamada et al. ..... 333/202

FOREIGN PATENT DOCUMENTS

JP 7-321509 12/1995
JP 11-312954 11/1999
JP 2000349580 A * 12/2000 ..... H03H/7/12

OTHER PUBLICATIONS

Japanese Office Action issued Jun. 15, 2004 (w/ English translation of relevant portions).

* cited by examiner

*Primary Examiner*—Robert Pascal
*Assistant Examiner*—Dean Takaoka
(74) *Attorney, Agent, or Firm*—Dickstein, Shapiro, Morin & Oshinsky, LLP.

(57) ABSTRACT

A shared-antenna device having a transmission circuit electrically connected between a transmission terminal and an antenna terminal, and a reception circuit electrically connected between a reception terminal and the antenna terminal. The transmission circuit is a variable-frequency band-stop filter circuit and the reception circuit is a variable-frequency bandpass filter circuit. Control-voltage supplying resistors are connected to the PIN diodes such that the DC voltages for individually controlling the PIN diodes are applied to the PIN diodes via only the resistors.

8 Claims, 7 Drawing Sheets

VARIABLE-FREQUENCY RESONATOR CIRCUIT, VARIABLE-FREQUENCY FILTER, SHARED-ANTENNA DEVICE, AND COMMUNICATION DEVICE

BACKGROUND OF THE INVENTION

1. Field of the Invention

The present invention relates to a variable-frequency resonator circuit, a variable-frequency filter, a shared-antenna device, and a communication device that are used, for example, in the microwave band.

2. Description of the Related Art

A variable-frequency shared-antenna device 1 having the circuit configuration shown in FIG. 8 has been known in the art. This shared-antenna device 1 has a plurality of variable-frequency resonator circuits each having a configuration in which a PIN diode is connected to a resonator via a capacitor. By controlling the voltage of these PIN diodes it is possible for a transmission circuit 25 and a reception circuit 26 to switch between two different passbands thereof.

In FIG. 8, Tx represents a transmission terminal, Rx represents a reception terminal, ANT represents an antenna, reference numerals 2 and 3 are resonators of the transmission circuit 25, reference numerals 4 to 6 are resonators of the reception circuit 26, L1 and L11 are coupling coils, C1 and C2 are coupling capacitors which determine the magnitude of the attenuation in the stop band, C5 and C6 are capacitors, L16 and L17 are resonance coils, C3 and C4 and C7 to C9 are frequency-band-varying capacitors, D2 to D6 are PIN diodes, L2 and L3 and L6 to L8 are choke coils, R1 and R2 are control-voltage supplying resistors, C22 and C23 are control-voltage supplying capacitors, L20 and L21 are coils forming a phase circuit, C15 is a capacitor forming the phase circuit, and C11 and C12 are coupling capacitors.

CONT1 is a voltage control terminal for controlling the voltage of the PIN diodes D2 and D3 in the transmission circuit 25, and CONT2 is a voltage control terminal for controlling the voltage of the PIN diodes D4 to D6 in the reception circuit 26. When a positive voltage is applied to these voltage control terminals CONT1 and CONT2, the PIN diodes D2 to D6 enter an ON state. Therefore, since the frequency-varying capacitors C3 and C4 and C7 to C9 are grounded through the PIN diodes D2 to D6, respectively, the resonance frequency is reduced and the shared-antenna device 1 operates in a LOW channel. In other words, the passbands of both the transmission circuit 25 and the reception circuit 26 shift towards the low frequency side.

Conversely, if no voltage is applied to the voltage control terminals CONT1 and CONT2, that is, if the control voltage is set to 0 V, or alternatively, if a negative DC voltage is applied to the voltage control terminals CONT1 and CONT2, the PIN diodes D2 to D6 enter an OFF state. Therefore, since the frequency-varying capacitors C3 and C4 and C7 to C9 become open-circuited, the resonance frequency increases and the shared-antenna device 1 operates in a HIGH channel. That is to say, the passbands of both the transmission circuit 25 and the reception circuit 26 move towards the high frequency side.

In the variable-frequency shared-antenna device 1 of the related art, DC control voltages for controlling the ON/OFF state of the PIN diodes D2 to D6 are applied to the PIN diodes D2 to D6 via the control-voltage supply resistors R1 and R2 and via the choke coils L2 and L3 and L6 to L8. Here, the choke coils L2 and L3 and L6 to L8 function to prevent the impedance at the voltage control terminals CONT1 and CONT2 from exerting an influence on the shared-antenna device 1. Coils having a high impedance at high frequencies may be used as the choke coils. It is necessary to use these choke coils L2 and L3 and L6 to L8 for the resonators 2 to 6, respectively. However, the size of these components is relatively large and the cost is also high. Accordingly, this has resulted in increased size and increased cost of the shared-antenna device 1.

Furthermore, the control-voltage supplying resistors R1 and R2 determine the values of the DC currents flowing in the PIN diodes D2 to D6. In order to reduce the number of components, these resistors R1 and R2 are not connected to each of the resonators 2 to 6, but rather, only one resistor is connected to each of the voltage control terminals CONT1 and CONT2. Therefore, regarding the values of the individual DC currents flowing the PIN diodes D2 to D6, the currents flowing in the PIN diodes D2 and D3, which are connected to the voltage control terminal CONT1, are identical, and the currents flowing in the PIN diodes D4 to D6, which are connected to the voltage control terminal CONT2, are identical.

Since the PIN diodes D2 to D6 are nonlinear elements, when a large electrical power is input, high-frequency signal distortion occurs, which is undesirable. In order to suppress this distortion, it is necessary to generate a large DC current flow in the PIN diodes that cause this distortion. However, in the shared-antenna device 1 of the related art, since identical DC currents flow in all of the PIN diodes D2 and D3 (or D4 to D6) that are connected to the voltage control terminal CONT1 (or CONT2), a large current also flows even in those PIN diodes that do not cause the distortion. Accordingly, a wasteful current flows, thus causing the battery of a mobile telephone terminal device to become drained quickly, which is a problem.

Moreover, in the related art, a variable-frequency resonator circuit is known in which a DC voltage for controlling a variable-capacitance diode is applied to the variable-capacitance diode via only a resistor. However, since a feature of the variable-capacitance diode is that it does not require a DC current to flow, no problems occur even though a high-impedance resistor (for example, several tens of kilo-ohms) is directly connected to the variable-capacitance diode.

SUMMARY OF THE INVENTION

An object of the present invention is to provide a variable-frequency resonator circuit, a variable-frequency filter, a shared-antenna device, and a communication device which have a small current consumption and a reduced number of components, and which are compact.

In order to achieve the above objects, a variable-frequency resonator circuit according to the present invention is provided with a configuration wherein one end of a resonator is grounded and a PIN diode is electrically connected to the other end thereof, a resistor is connected to the PIN diode, and a DC control voltage for controlling the PIN diode is applied to the PIN diode via only the resistor. Alternatively, the variable-frequency resonator circuit according to the present invention may be provided with a configuration wherein one end of a resonator is grounded and one end of a PIN diode is electrically connected to the other end of the resonator via a capacitor, a resistor is connected to the connection point between the PIN diode and the capacitor, and a DC voltage for controlling the PIN diode, whose other end is grounded, is applied to the connection point between the capacitor and the PIN diode via only the resistor.

According to the structure described above, if, for example, a positive voltage is applied as a control voltage to the voltage control terminal, the PIN diode enters an ON state, and therefore the resonance frequency of the variable-frequency resonator circuit increases. On the other hand, if no voltage is applied to the voltage control terminal, that is to say, if a control voltage of 0 V is applied, or alternatively, if a negative control voltage is applied to the voltage control terminal, the PIN diode enters an OFF state, and therefore the resonance frequency of the variable-frequency resonator circuit decreases.

Moreover, by providing a variable-frequency resonator having the above-described characteristics, a variable-frequency filter according to the present invention has a reduced number of components and can thus be made more compact.

A shared-antenna device according to another aspect of the present invention is characterized in that a first filter, which is connected between a shared terminal and a first individual terminal, and a second filter, which is connected between the shared terminal and a second individual terminal, are provided, and at least one of the first filter and the second filter is the variable-frequency filter having the features described above.

By appropriately setting the resistance of the resistor connected to each variable-frequency resonator circuit, the DC current consumptions of the variable-frequency resonator circuits of the first filter and the DC current consumptions of the variable-frequency resonator circuits of the second filter can be made to differ from each other. Alternatively, the DC current consumption of at least one of the variable frequency resonator circuit connected to the shared terminal in the first filter and the variable-frequency resonator circuit connected to the shared terminal in the second filter can be made larger than the DC current consumptions of the other variable-frequency resonator circuits.

According to the configuration described above, it is possible to make a large DC current flow selectively in only those PIN diodes that cause high-frequency signal distortion. Normally, the PIN diodes that cause high-frequency signal distortion are the PIN diodes of the variable-frequency resonator circuit that are connected to the shared terminal. Therefore, by setting the resistances of the resistors so that the DC current consumptions of the variable-frequency resonator circuits connected to the shared terminal are at least 0.6 mA, the efficiency is improved, and high-frequency signal distortion can be reliably suppressed.

DESCRIPTION OF THE PREFERRED EMBODIMENTS

A description of a variable-frequency resonator circuit, a variable-frequency filter, a shared-antenna device, and a communication device according to the present invention is given below with reference to the attached drawings.

First Embodiment (FIGS. 1 to 4)

Figure 1:
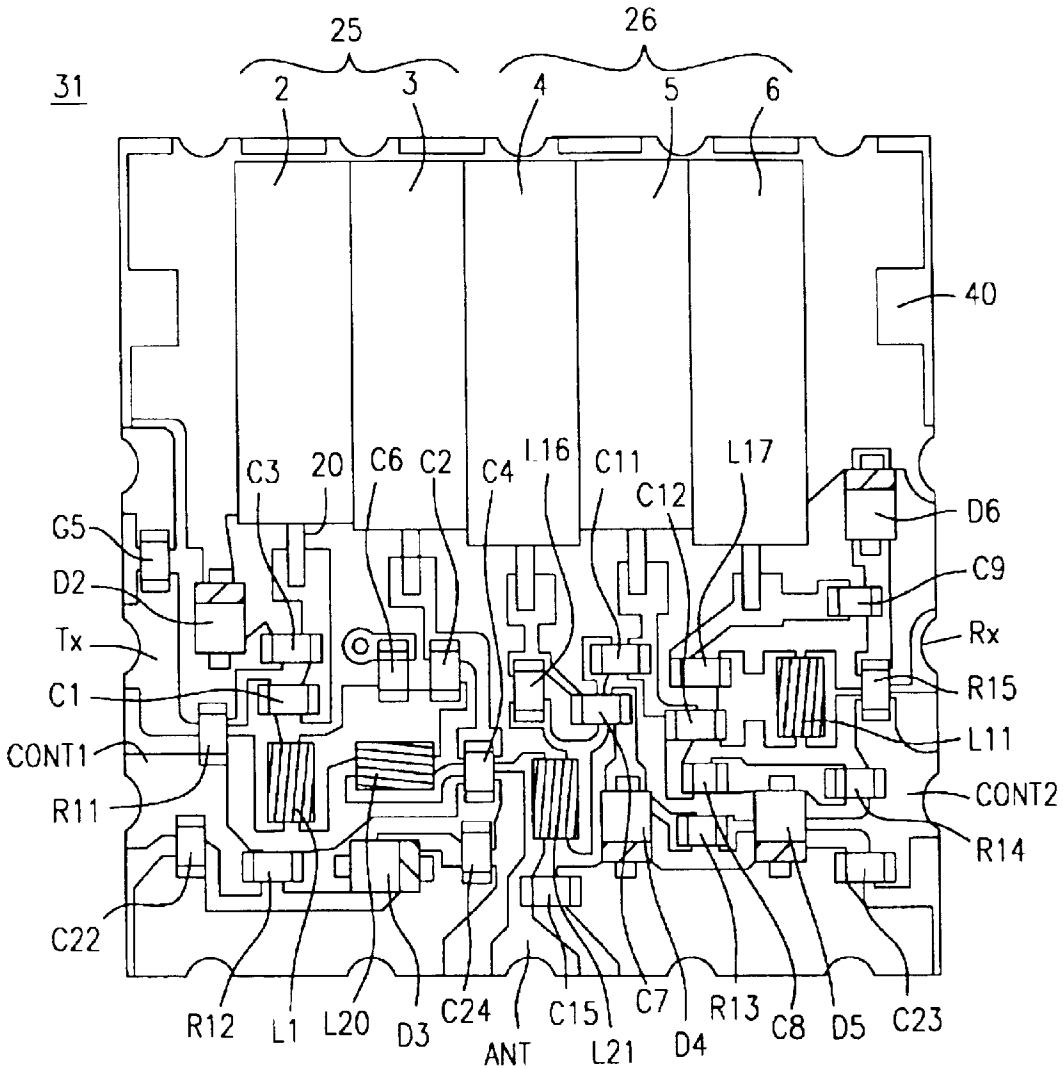
FIG. 1 is a plan view showing the structure of one embodiment of a shared-antenna device according to the present invention.

FIG. 1 is a plan view of a shared-antenna device 31 in which individual components are mounted on a circuit substrate 40. In the shared-antenna device 31, a transmission circuit 25 is electrically connected between a transmission terminal Tx and an antenna terminal ANT, and a reception circuit 26 is electrically connected between a reception terminal Rx and the antenna terminal ANT. This shared-antenna device 31 outputs a transmission signal, which is input to the transmission terminal Tx from a transmission-system circuit, to the antenna terminal ANT via the transmission circuit 25. The shared-antenna device 31 also outputs a reception signal, which is input from the antenna terminal ANT, from the reception terminal Rx to a reception-system circuit via the reception circuit 26.

Figure 2:
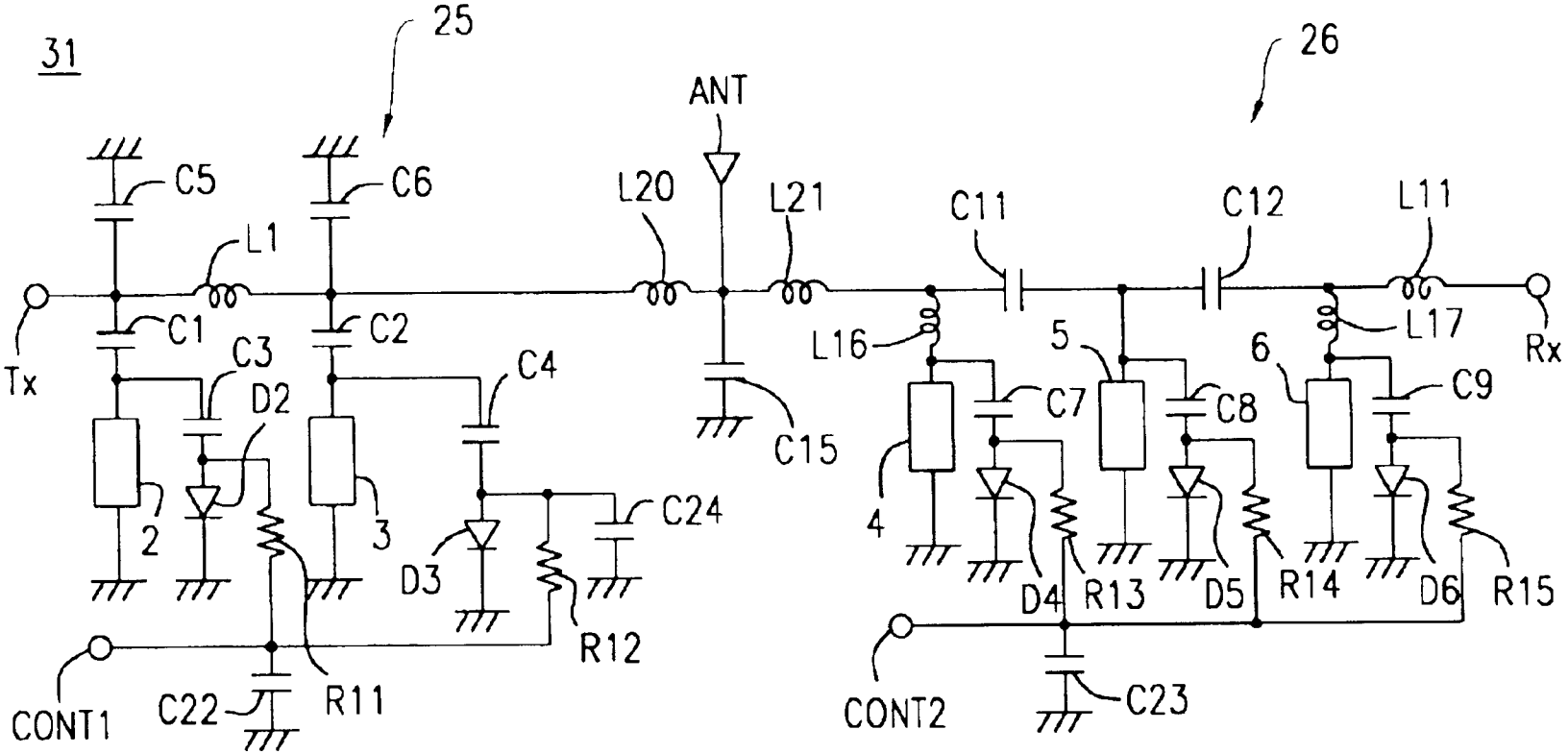
FIG. 2 is an electrical circuit diagram of the shared-antenna device shown in FIG. 1.

FIG. 2 shows an electrical circuit diagram of the shared-antenna device 31. The transmission circuit 25 is a variable-frequency band-stop filter circuit. In this band-stop filter circuit 25, variable-frequency resonator circuits are connected in two stages, including a resonator 2 which is electrically connected to the transmission terminal Tx via a resonance capacitor C1 and a resonator 3 which is electrically connected to the antenna terminal ANT via a resonance capacitor C2 and a matching coil L20. The matching coil L20 functions as a reactance element for performing phase synthesis of the transmission circuit 25 and the reception circuit 26. The resonance capacitors C1 and C2 determine the magnitude of the attenuation in the stop-band. The series resonance circuit of the resonator 2 and the resonance capacitor C1 is electrically connected to the series resonance circuit of the resonator 3 and the resonance capacitor C2 via a coupling coil L1. Furthermore, capacitors C5 and C6 are electrically connected in parallel to these two series resonance circuits, respectively.

As shown in FIG. 2, at the connection point between the resonator 2 and the resonance capacitor C1, a PIN diode D2, which is a reactance element, is electrically connected in parallel to the resonator 2 via a frequency-varying capacitor C3 while the cathode of the PIN diode D2 is grounded. Similarly, at the connection point between the resonator 3 and the resonance capacitor C2, a PIN diode D3 is electrically connected in parallel to the resonator 3 via a frequency-varying capacitor C4 while the cathode of the PIN diode D3 is grounded. The frequency-varying capacitors C3 and C4 function to change two corresponding attenuation-pole frequencies in the attenuation characteristic of the variable-frequency band-stop filter circuit 25. Furthermore, a capacitor C24 is connected between the anode of the PIN diode D3 and ground.

The voltage control terminal CONT1 is electrically connected to the connection point between the anode of the PIN diode D2 and the frequency-varying capacitor C3 via a control-voltage supplying resistor R11 and a bypass capacitor C22. The voltage control terminal CONT1 is also electrically connected to the connection point between the anode of the PIN diode D3 and the frequency-varying capacitor C4 via a control-voltage supplying resistor R12 and the bypass capacitor C22.

A capacitor C15 is electrically connected between the ground and the antenna terminal ANT. The capacitor C15 forms a T-shaped phase circuit together with the matching coil L20 of the transmission circuit 25 and a matching coil L21 of the reception circuit 26.

The reception circuit 26 is a variable-frequency bandpass filter circuit. This variable-frequency bandpass filter circuit 26 has variable-frequency resonator circuits connected in three stages, including a resonator 4 electrically connected to the antenna terminal ANT via a resonance coil L16 and the matching coil L21, a resonator 6 electrically connected to the reception terminal Rx via a resonance coil L17 and a matching coil L11, and a resonator 5 electrically connected between the resonators 4 and 6 via coupling capacitors C11 and C12.

The matching coils L21 and L11 function as input and output reactance elements for matching the variable-frequency bandpass filter circuit 26 and an external circuit, respectively.

At the connection point between the resonator 4 and the resonance coil L16, a series circuit of a frequency-varying capacitor C7 and a PIN diode D4 is electrically connected in parallel with the resonator 4 while the cathode of the PIN diode D4 is grounded. At the connection point between the resonator 5 and the coupling capacitors C11 and C12, a series circuit of a frequency-varying capacitor C8 and a PIN diode D5 is electrically connected in parallel with the resonator 5 while the cathode of the PIN diode D5 is grounded. At the connection point between the resonator 6 and the resonance coil L17, a series circuit of a frequency-varying capacitor C9 and a PIN diode D6 is electrically connected in parallel with the resonator 6 while the cathode of the PIN diode D6 is grounded.

The voltage control terminal CONT2 is electrically connected to the connection point between the anode of the PIN diode D4 and the frequency-varying capacitor C7 via a bypass capacitor C23 and a control-voltage supplying resistor R13. The voltage control terminal CONT2 is also electrically connected to the connection point between the anode of the PIN diode D5 and the frequency-varying capacitor C8 via the bypass capacitor C23 and a control-voltage supplying resistor R14. Furthermore, the voltage control terminal CONT2 is also electrically connected to the connection point between the anode of the PIN diode D6 and the frequency-varying capacitor C9 via the bypass capacitor C23 and a control-voltage supplying resistor R15.

Figure 3:
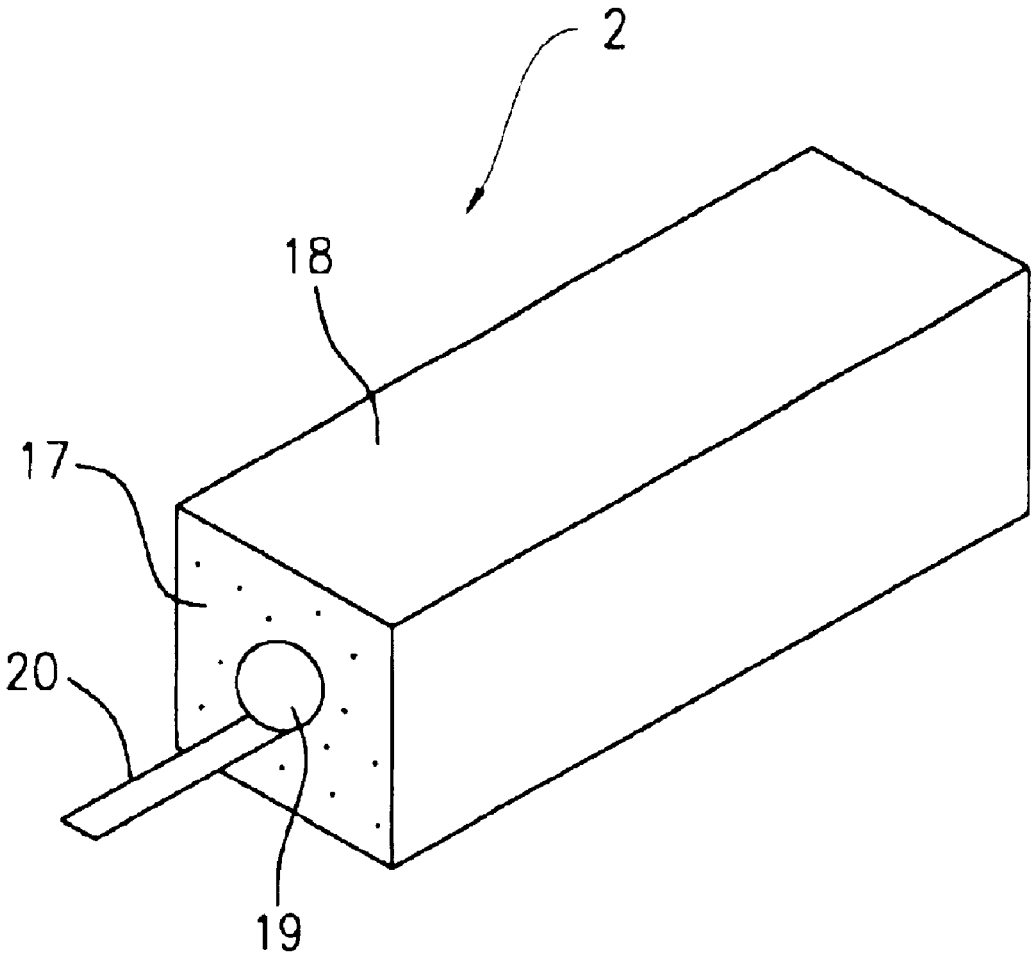
FIG. 3 is a perspective view of one example of a resonator used in the shared-antenna device shown in FIG. 1.
Figure 4:
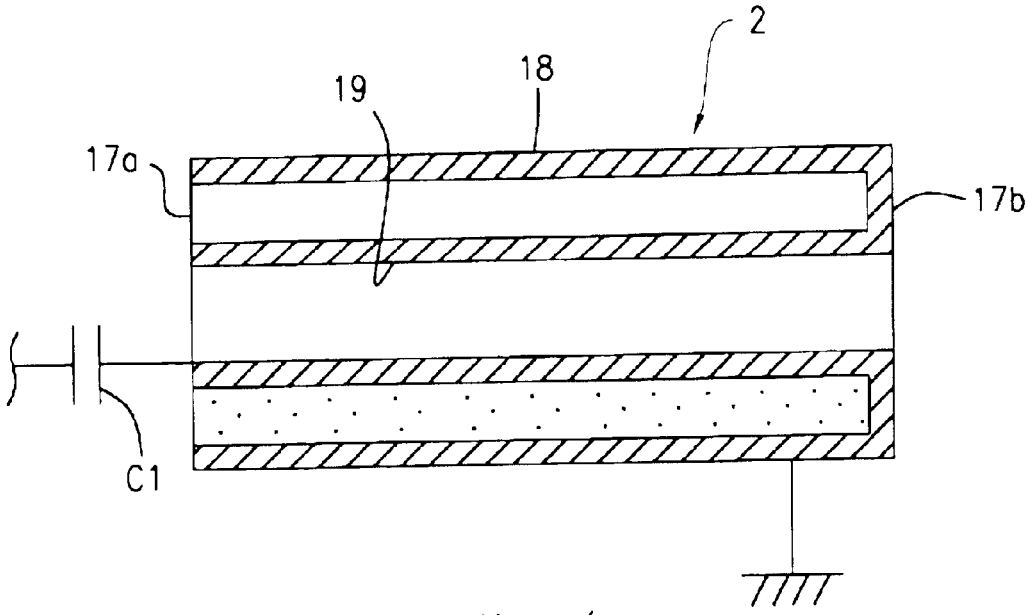
FIG. 4 is a sectional view of the resonator shown in FIG. 3.

Here, as shown for example in FIGS. 3 and 4, ¼ uniaxial dielectric resonators are used as the resonators 2 to 6. FIGS. 3 and 4 show a representative example of the resonator 2. The dielectric resonators 2 to 6 are each configured of a columnar dielectric 17 which is formed of a material having a high dielectric constant, such as a TiO2 based ceramic, an outer conductor 18 which is provided on the outer peripheral surfaces of the columnar dielectric 17, and an inner conductor 19 which is provided on an inner circumferential surface of the columnar dielectric 17. The outer conductor 18 is electrically open with respect to (that is to say, separated from) the inner conductor 19 at an open end 17*a* (hereinafter referred to as an open-circuit end 17*a*) at one end of the dielectric 17. The outer conductor 18 is electrically short-circuited with respect to (that is to say, connected to) the inner conductor 19 at an open end 17*b* (hereinafter referred to as a short-circuit end 17*b*) at the other end of the dielectric 17. At the open-circuit end 17*a*, the dielectric resonator 2 is electrically connected to the resonance capacitor C1 via a conductor 20 or the like. These dielectric resonators 2 to 6 are soldered together with the outer conductor 18 to be integrated.

As shown in FIG. 1, the control-voltage supplying resistors R11 to R15 are surface-mountable chips. The resistors R11 to R15 determine the values of the DC currents flowing in the PIN diodes D2 to D6, respectively. Since the impedances at the voltage control terminals CONT1 and CONT2 should not exert an influence the shared-antenna device 31, high-impedance resistors preferably having a resistance of 3 kW or more) are used as these resistors R11 to R15. Furthermore, as the PIN diodes D2 to D6, diodes having a small DC current consumption and a low forward-bias resistance are used.

Accordingly, since the control-voltage supplying resistors R11 to R15 are connected to the PIN diodes D2 to D6, respectively, it is possible to make large DC currents selectively flow in only the PIN diodes that cause the high-frequency signal distortion. In other words, the PIN diodes that influence the high-frequency signal distortion are the PIN diodes D3 and D4 of the transmission circuit 25 and the reception circuit 26, respectively, that are closest to the antenna terminal ANT. Thus, by setting the resistance of the resistors R11 to R15 so that large DC currents (preferably at least 0.6 mA) flow in only the PIN diodes D3 and D4, it is possible to provide a shared-antenna device 31 in which the current efficiency is improved and in which high-frequency signal distortion is reliably suppressed.

Moreover, it is also possible to set the resistance values of the resistors R11 to R15 so that the DC currents flowing in the PIN diodes D2 and D3 of the transmission circuit 25 and the DC currents flowing in the PIN diodes D4 to D6 of the reception circuit 26 differ from each other.

Next, a description will be given of the operation and effects of the shared-antenna device 31 structured as described above. The trap frequency of the variable-frequency band-stop filter circuit 25, which is the transmission circuit, is determined by the resonance frequency of the resonating system formed of the frequency-varying capacitor C3, the resonance capacitor C1, and the resonator 2 and the resonance frequency of the resonating system formed of the frequency-varying capacitor C4, the resonance capacitor C2, and the resonator 3. When a positive voltage is applied as a control voltage to the voltage control terminal CONT1, the PIN diodes D2 and D3 enter an ON state. Thus, the frequency-varying capacitors C3 and C4 are grounded through the PIN diodes D2 and D3, respectively, and the frequencies of the two attenuation poles both decrease, thus reducing the passband of the transmission circuit 25.

Conversely, when a negative voltage is applied as a control voltage to the voltage control terminal CONT1, the PIN diodes D2 and D3 enter an OFF state. Instead of applying a negative voltage, it is also possible to set the PIN diodes D2 and D3 to the OFF state by setting the control voltage to 0 V, that is to say, by applying no voltage to the voltage control terminal CONT1. Thus, the frequency-varying capacitors C3 and C4 enter an open-circuit state and the two attenuation pole frequencies both increase, thus increasing the passband of the transmission circuit 25. Accordingly, by alternately grounding the frequency-varying capacitors C3 and C4 and setting an open-circuit state by controlling the voltage, it is possible to provide two different passband characteristics for the transmission circuit 25.

The passing frequencies of the variable-frequency bandpass filter circuit 26, which is the reception circuit, are determined by (1) the resonance frequency of the resonating system formed of the frequency-varying capacitor C7, the resonance coil L16, and the resonator 4, (2) the resonance frequency of the resonating system formed of the frequency-varying capacitor C8 and the resonator 5, and (3) the resonance frequency of the resonating system formed of the frequency-varying capacitor C9, the resonance coil L17, and the resonator 6. Then, when a positive voltage is applied as a control voltage to the voltage control terminal CONT2, the PIN diodes D4, D5, and D6 enter an ON state. Therefore, the frequency-varying capacitors C7, C8, and C9 are grounded through the PIN diodes D4, D5, and D6, respectively, thus reducing the passing frequencies.

Conversely, when a negative voltage is applied as a control voltage to the voltage control terminal CONT2, the PIN diodes D4, D5, and D6 enter an OFF state. Therefore, the frequency-varying capacitors C7, C8, and C9 enter an open-circuit state, thus increasing the passing frequencies. Accordingly, by alternately grounding the frequency-varying capacitors C7 to C9 and setting an open-circuit state by controlling the voltage, it is possible to provide two different passband characteristics for the reception circuit 26.

This variable-frequency bandpass filter circuit 26 can match the two passbands of the transmission circuit 25, namely a high passband and a low passband, by switching between them. That is to say, voltage control is performed so that when the low frequency passband is selected as the transmission band the bandpass frequency is reduced, and when the high-frequency passband is selected as the transmission band the bandpass frequency is increased. Accordingly, it is possible to provide a compact, low-cost shared-antenna device 31 having a reduced number of components (in the case of the first embodiment, the number of components can be reduced by two).

Figure 5:
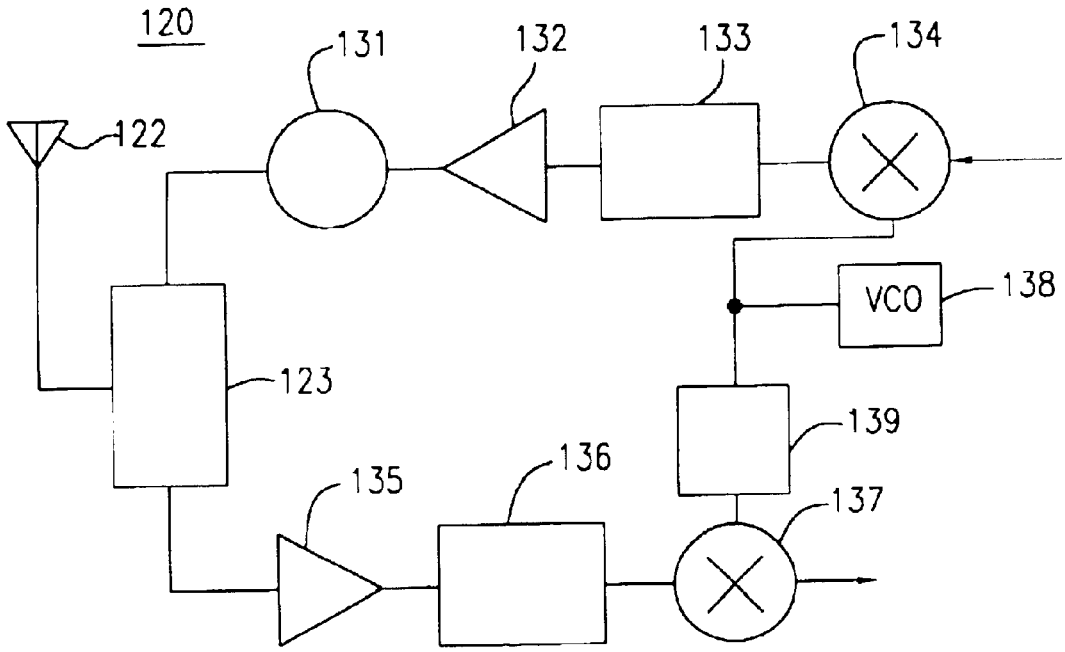
FIG. 5 is a circuit diagram showing an embodiment of a communication device according to the present invention.

Second Embodiment (FIG. 5)

A second embodiment will now be described using a mobile telephone, which is a communication device according to the present invention, as an example.

FIG. 5 is a block diagram showing an electrical circuit diagram of an RF section of a mobile telephone 120. In FIG. 5, reference numeral 122 is an antenna element, reference numeral 123 is a duplexer, reference numeral 131 is a transmission isolator, reference numeral 132 is a transmission amplifier, reference numeral 133 is a transmission inter-stage bandpass filter, reference numeral 134 is a transmission mixer, reference numeral 135 is a reception amplifier, reference numeral 136 is a reception inter-stage bandpass filter, reference numeral 137 is a reception mixer, reference numeral 138 is a voltage controlled oscillator (VCO), and reference numeral 139 is a local bandpass filter.

Here, the shared-antenna device 31 according to the first embodiment described above can be used as the duplexer 123. By providing the shared-antenna device 31, it is possible to realize a compact mobile telephone in which high-frequency signal distortion, electrical power consumption, and the number of components are small.

The variable-frequency resonator circuit, the variable-frequency filter, the shared-antenna device, and the communication device according to the present invention are not limited to the embodiments described above. It is possible to make various modifications within the spirit and scope of the present invention.

EXAMPLE

As a mobile telephone system using a shared-antenna device employing a variable-frequency resonator circuit, the "cdmaOne" system in Japan may be considered as an example. As one quality standard for the "cdmaOne" system, there is a standard test for evaluating the high-frequency signal distortion, i.e., the "single tone desensitization" test. This is a test in which interference waves are input during transmission and the reception sensitivity is measured, thus allowing the high-frequency signal distortion in the shared-antenna device to be evaluated.

Figure 6:
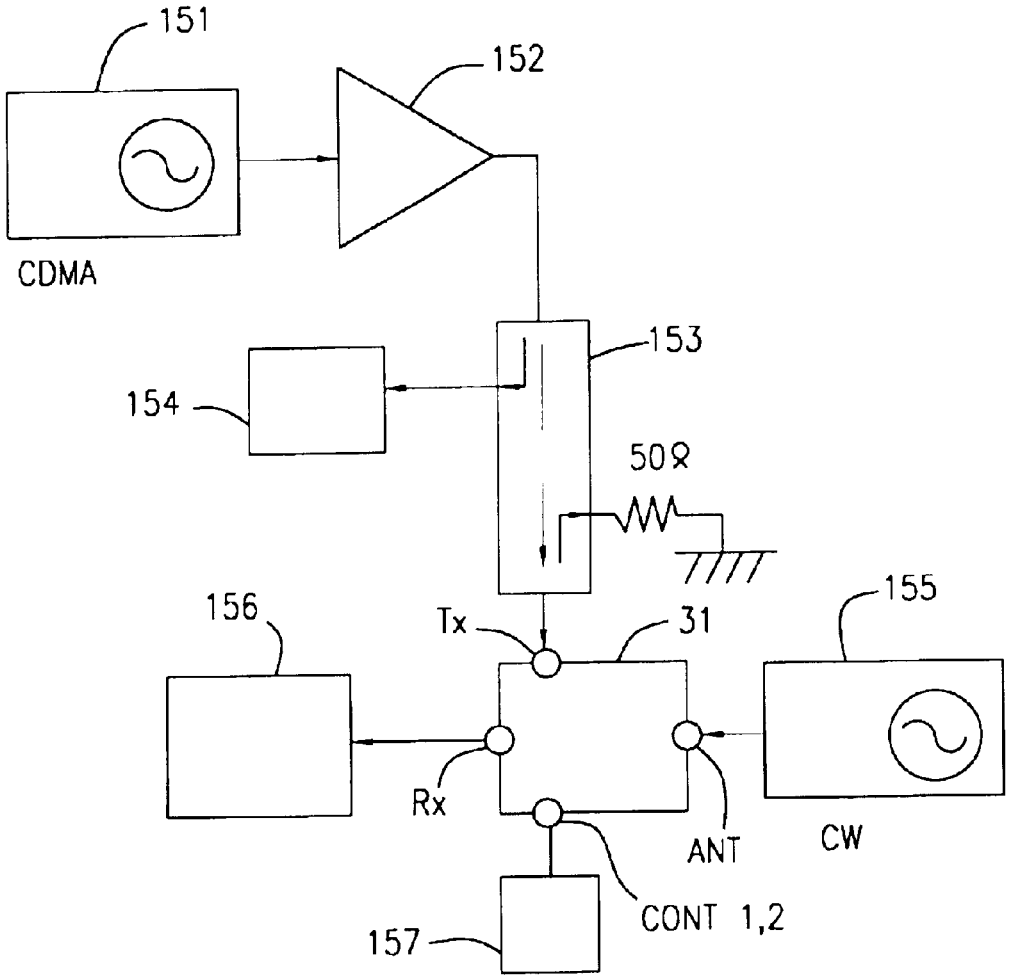
FIG. 6 is a circuit diagram showing an example circuit for measuring single tone desensitization.

An example measuring circuit is shown in FIG. 6. In FIG. 6, reference numerals 151 and 155 are voltage-controlled oscillators (VCOs), reference numeral 152 is an amplifier, reference numeral 153 is a coupler, reference numeral 154 is an electrical power meter, reference numeral 156 is a spectrum analyzer, and reference numeral 157 is a DC power supply apparatus. Transmission waves (CDMA modulated waves) output from the voltage-controlled oscillator 151 are amplified in the amplifier 152, pass through the coupler 153, and are input to the transmission terminal Tx of the shared-antenna device 31 under test.

Interference waves (CW signal waves) having a frequency of ±900 kHz with respect to the reception waves, are output from the voltage-controlled oscillator 155 and are input to the antenna terminal ANT of the shared-antenna device 31. The spectrum analyzer 156 is connected to the reception terminal Rx of the shared-antenna device 31 and measures the noise at the reception frequency.

If interference waves are input during transmission, an intermodulation phenomenon occurs in the shared-antenna device 31, which causes noise to be generated at the reception frequency, thereby making it difficult to receive the reception waves. High-frequency signals are also distorted. This is the single tone desensitization test. In the present invention, it has been determined from experimental observations that the PIN diodes that cause the high-frequency signal distortion are the PIN diodes D3 and D4 that are closest to the antenna terminal ANT, in the transmission circuit 25 and the reception circuit 26, respectively.

Accordingly, by setting the resistances of the resistors R11 to R15 of the shared-antenna device 31 to the values shown below, a large DC current can be made to flow only in the PIN diodes D3 and D4, thus improving the high-frequency distortion characteristics:

Resistors R11, R13: 3 kW

Resistors R12, R14, R15: 1 kW.

In this case, when a control voltage of +3 V is applied by the DC power supply device 157 to the voltage control terminals CONT1 and CONT2, the individual DC currents flowing in the PIN diodes D2 to D6 are the values shown below, and the total current is 2.6 mA:

PIN diodes D3, D4: 0.66 mA

PIN diodes D2, D5, D6: 0.43 mA.

Conversely, in the case of the shared-antenna device according to the related art, if a DC current of 0.66 mA is made to flow in the PIN diodes D3 and D4, a DC current of 0.66 mA also flows in the PIN diodes D2, D5, and D6. Therefore, the total DC current consumption is 3.3 mA, which is approximately 0.7 mA higher than the DC current consumption in the shared-antenna device according to the present invention.

Figure 7:
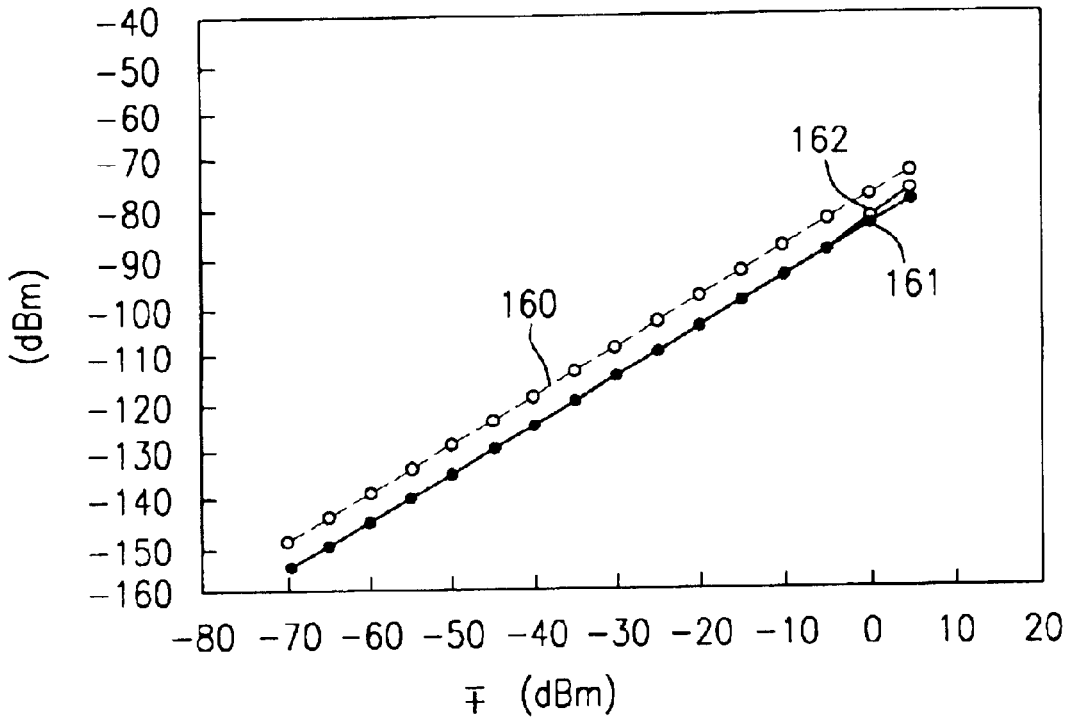
FIG. 7 is a graph showing measurement results of single tone desensitization.
Figure 8:
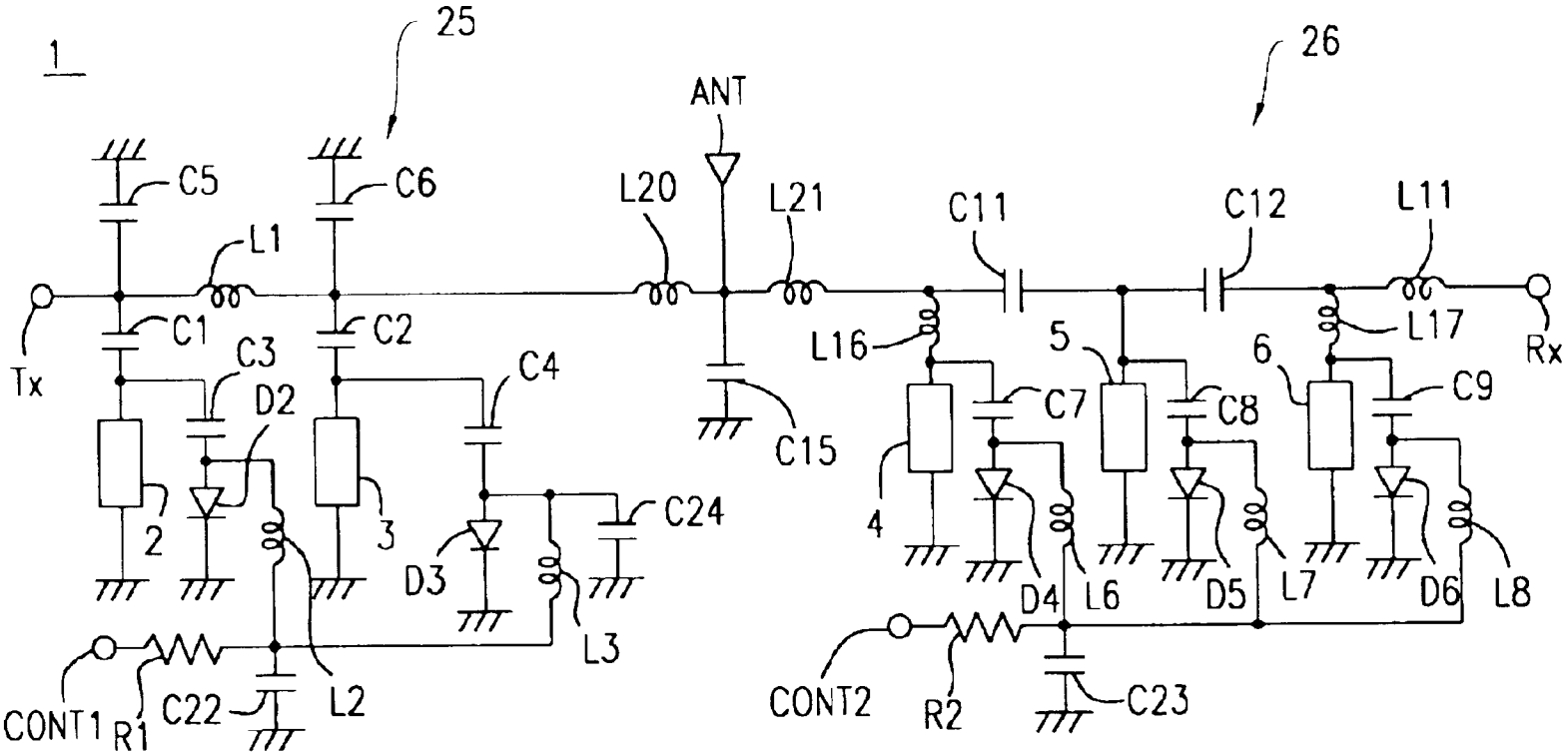
FIG. 8 PRIOR ART
FIG. 8 is an electrical circuit diagram showing an example of a shared-antenna device according to the related art.

FIG. 7 is a graph showing an example of the measurement results of the single tone desensitization. This graph shows the results when the power of the transmission waves (CDMA modulated waves) is 27 dBm and the frequency is 887 MHz, and the frequency of the interference waves (CW signal waves) is 832.9 MHz. The dotted line 160 represents the shared-antenna device according to the present invention before the distortion characteristics are improved, the solid line 161 represents the shared-antenna device according to the present invention after the distortion characteristics are improved, and the solid line 162 represents the shared-antenna device according to the related art after improvement of the distortion characteristics. From FIG. 7 it is clear that the shared-antenna device according to the present invention has a small DC current consumption compared with the shared-antenna device according to the related art after improvement of the distortion characteristics, and can obtain substantially the same improvement(about 7 dBm) of the distortion characteristics as in the shared-antenna device according to the related art after improvement of the distortion characteristics.

What is claimed is:

1. A shared-antenna device comprising:

a shared terminal;

a first individual terminal;

a first filter connected between the shared terminal and the first individual terminal;

a second individual terminal; and a second filter connected between the shared terminal and the second individual terminal, wherein each of the first filter and the second filter include at least two variable-frequency resonator circuits which comprise:

a resonator having a grounded end and an ungrounded end;

a capacitor electrically connected to the ungrounded end of the resonator;

a PIN diode having a first end electrically connected to the ungrounded end of the resonator via the capacitor and a second grounded end; and a resistor connected at a connection point between the PIN diode and the capacitor, wherein a DC voltage for controlling the PIN diode is applied to the connection point between the capacitor and the PIN diode via only the resistor, and wherein the resistances of each resistor in each of the at least two variable-frequency resonator circuits in each of the first filter and the second filter are set such that a DC current consumption of at least one of the at least two variable-frequency resonator circuits is different from a DC current consumption of another of the at least two variable-frequency resonator circuits.

2. A shared-antenna device comprising:

a shared terminal;

a first individual terminal;

a first filter connected between the shared terminal and the first individual terminal;

a second individual terminal; and a second filter connected between the shared terminal and the second individual terminal, wherein each of the first filter and the second filter include at least two variable-frequency resonator circuits which comprise:

a resonator having a grounded end and an ungrounded end;

a capacitor electrically connected to the ungrounded end of the resonator;

a PIN diode having a first end electrically connected to the ungrounded end of the resonator via the capacitor and a second grounded end; and a resistor connected at a connection point between the PIN diode and the capacitor, wherein a DC voltage for controlling the PIN diode is applied to the connection point between the capacitor and the PIN diode via only the resistor, and wherein the resistances of each at least one resistor in each of the first filter and the second filter are set so that a DC current consumption of the variable-frequency resonator circuit of the first filter differs from a DC current consumption of the variable-frequency resonator circuit of the second filter, and wherein the resistances of each resistor in each of the at least two variable-frequency resonator circuits in each of the first filter and the second filter are set such that a DC current consumption of at least one of the at least two variable-frequency resonator circuits is different from a DC current consumption of another of the at least two variable-frequency resonator circuits.

3. A shared-antenna device comprising:

a shared terminal;

a first individual terminal;

a first filter connected between the shared terminal and the first individual terminal;

a second individual terminal; and a second filter connected between the shared terminal and the second individual terminal, wherein each of the first filter and the second filter is a variable-frequency filter, each variable-frequency filter comprising at least two variable-frequency resonator circuits, each variable-frequency resonator circuit comprising:

a resonator having a grounded end and an ungrounded end;

a PIN diode electrically connected to the ungrounded end of the resonator; and a resistor electrically connected to the PIN diode, wherein a DC voltage for controlling the PIN diode is applied to the PIN diode via only the resistor, wherein the resistances of at least one resistor in each of the first filter and the second filter are set so that a DC current consumption of at least one of the variable-frequency resonator circuits of the first filter is larger than a DC current consumption of at least one of the variable-frequency resonator circuits of the second filter, and wherein the resistances of each resistor in each of the at least two variable-frequency resonator circuits in each of the first filter and the second filter are set such that a DC current consumption of at least one of the at least two variable-frequency resonator circuits is different from a DC current consumption of another of the at least two variable-frequency resonator circuits.

4. A shared-antenna device comprising:

a shared terminal;

a first individual terminal;

a first filter connected between the shared terminal and the first individual terminal;

a second individual terminal; and a second filter connected between the shared terminal and the second individual terminal, wherein each of the first filter and the second filter is a variable-frequency filter, each variable-frequency filter comprising at least two variable-frequency resonator circuits, each variable-frequency resonator circuit comprising:

a resonator having a grounded end and an ungrounded end;

a PIN diode electrically connected to the ungrounded end of the resonator; and a resistor electrically connected to the PIN diode, wherein a DC voltage for controlling the PIN diode is applied to the PIN diode via only the resistor, wherein the resistances of at least one resistor in each of the first filter and the second filter are set so that a DC current consumption of at least one of the variable-frequency resonator circuits of the first filter is larger than a DC current consumption of at least one of the variable-frequency resonator circuits of the second filter, and wherein the resistances of each resistor in each of the at least two variable-frequency resonator circuits in each of the first filter and the second filter are set such that a DC current consumption of at least one of the at least two variable-frequency resonator circuits is different from a DC current consumption of another of the at least two variable-frequency resonator circuit, and wherein the DC current consumption of the at least one variable-frequency resonator circuit is at least 0.6 mA.

5. A communication device comprising a filter according to claim 1.

6. A communication device comprising a filter according to claim 2.

7. A communication device comprising a filter according to claim 3.

8. A communication device comprising a filter according to claim 4.

* * * * *